US006213717B1

(12) United States Patent
Bucher et al.

(10) Patent No.: US 6,213,717 B1
(45) Date of Patent: Apr. 10, 2001

(54) BALANCING RING FOR A CEILING FAN

(75) Inventors: Charles Bucher, Ft Faudecdale, FL (US); San-Chi Wu, No. 69, Sung-Chu Rd., Pei-Tun Dist., Taichung City (TW)

(73) Assignee: San-Chi Wu, Taichung (TW)

( * ) Notice: Subject to any disclaimer, the term of this patent is extended or adjusted under 35 U.S.C. 154(b) by 0 days.

(21) Appl. No.: 09/415,127

(22) Filed: Oct. 8, 1999

(51) Int. Cl.[7] ..... F04D 29/66

(52) U.S. Cl. ..... 416/145; 415/119; 416/5; 416/500

(58) Field of Search ..... 415/119; 416/5, 416/144, 145, 500; 74/573 R

(56) References Cited

U.S. PATENT DOCUMENTS

| | | | | |
|---|---|---|---|---|
| 3,799,619 | * | 3/1974 | LaBarber | 301/5 BA |
| 4,075,909 | * | 2/1978 | Deakin | 74/573 |
| 5,256,037 | | 10/1993 | Chatelain | 417/423.7 |
| 5,593,281 | * | 1/1997 | Tai | 416/145 |
| 6,065,368 | * | 5/2000 | Sohn | 74/573 R |

FOREIGN PATENT DOCUMENTS

| | | | | |
|---|---|---|---|---|
| 931-970 | * | 5/1982 | (SU) | 416/145 |

* cited by examiner

*Primary Examiner*—Edward K. Look
*Assistant Examiner*—Liam McDowell
(74) *Attorney, Agent, or Firm*—Ladas and Parry

(57) ABSTRACT

A balancing ring for a ceiling fan includes a ring member, a plurality of metal balls, and a ball restraining ring. The ring member has a top side, a bottom side, an inner peripheral wall that confines a central opening, an outer peripheral wall, and an annular groove formed in the top side between the inner and outer peripheral walls. The groove has a groove bottom formed with an annular ball receiving recess. The metal balls are disposed in the ball receiving recess. The ball restraining ring is disposed in the groove above the groove bottom, and is movable inside the groove in at least an axial direction of the central opening between a restricting position, where the metal balls are restricted from moving freely, and a releasing position, where the metal balls are free to move in the ball receiving recess. The ball restraining ring moves in the groove in response to rotating speed of the balancing ring.

8 Claims, 8 Drawing Sheets

BALANCING RING FOR A CEILING FAN

BACKGROUND OF THE INVENTION

1. Field of the Invention

The invention relates to a ceiling fan, more particularly to a balancing ring for a ceiling fan.

2. Description of the Related Art

Referring to FIG. 1, in order to maintain balance and prevent swaying of a ceiling fan 1 when the latter operates, it is known in the art to provide a weight 4 on a top surface 3 of each fan blade 2 of the fan 1. The weight 4 is generally secured on the respective blade 2 with the use of a double-sided adhesive tape 5. However, it is noted that untimely removal of the weights 4 easily occurs when the blades 2 rotate at a relatively fast speed. In addition, proper installation of the weights 4 cannot be performed without the presence of a skilled technician.

SUMMARY OF THE INVENTION

Therefore, the object of the present invention is to provide a balancing ring, which can be easily and securely installed on a ceiling fan, to maintain balance and prevent swaying of the fan when the latter operates.

According to this invention, a balancing ring comprises a ring member, a plurality of metal balls, a ball restraining ring, and lifting means.

The ring member has a top side, a bottom side, an inner peripheral wall that confines a central opening, an outer peripheral wall, and an annular groove formed in the top side between the inner and outer peripheral walls. The groove has a groove bottom formed with an annular ball receiving recess.

The metal balls are disposed in the ball receiving recess.

The ball restraining ring is disposed in the groove above the groove bottom, and is movable inside the groove in at least an axial direction of the central opening between a restricting position, where the metal balls are restricted from moving freely, and a releasing position, where the metal balls are free to move in the ball receiving recess.

The lifting means, which is provided in the groove, permits movement of the ball restraining ring in the groove in response to rotating speed of the balancing ring.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
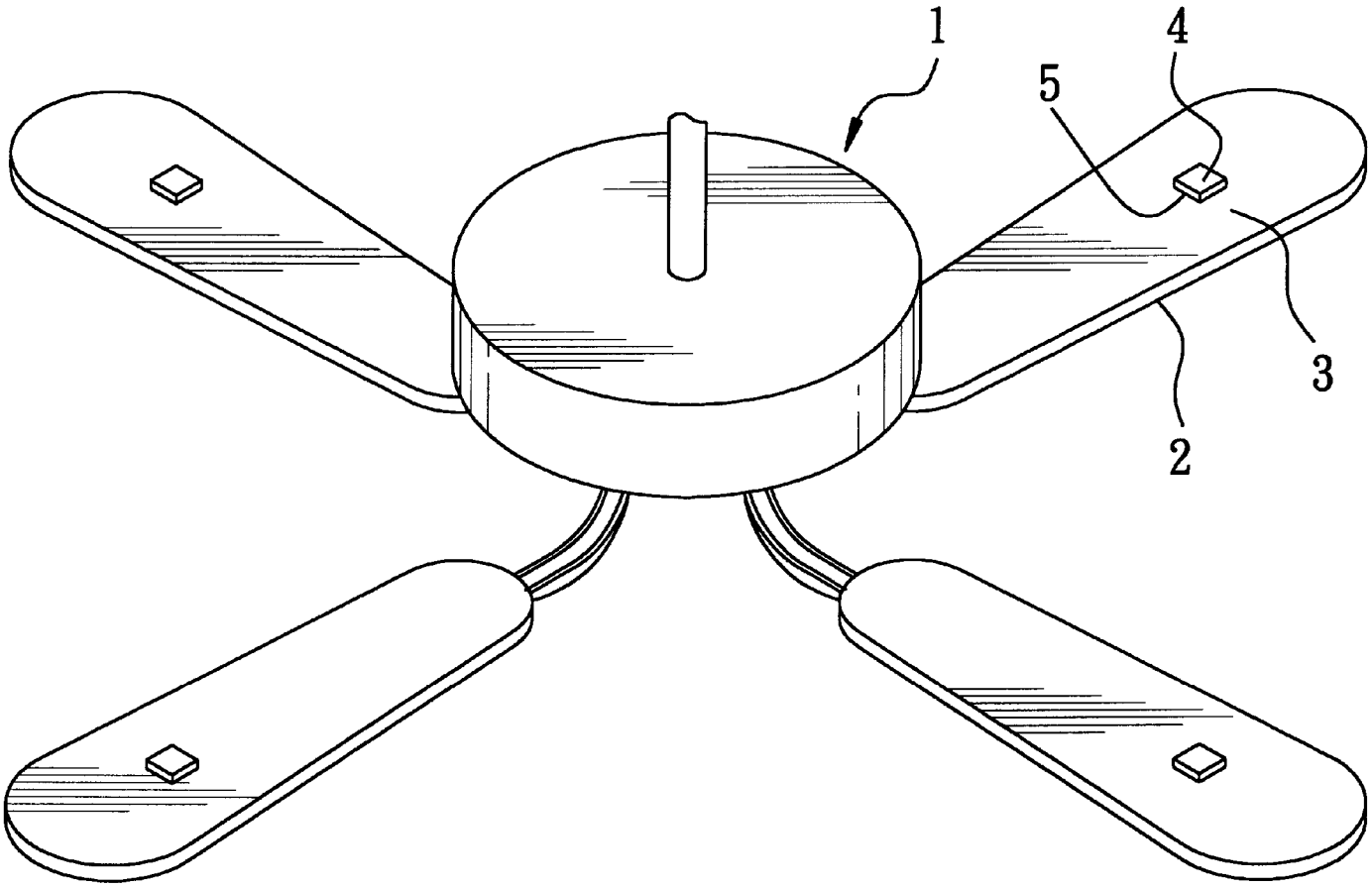
FIG. 1 PRIOR ART
FIG. 1 is a perspective view illustrating how a ceiling fan is balanced in a conventional manner.
Figure 2:
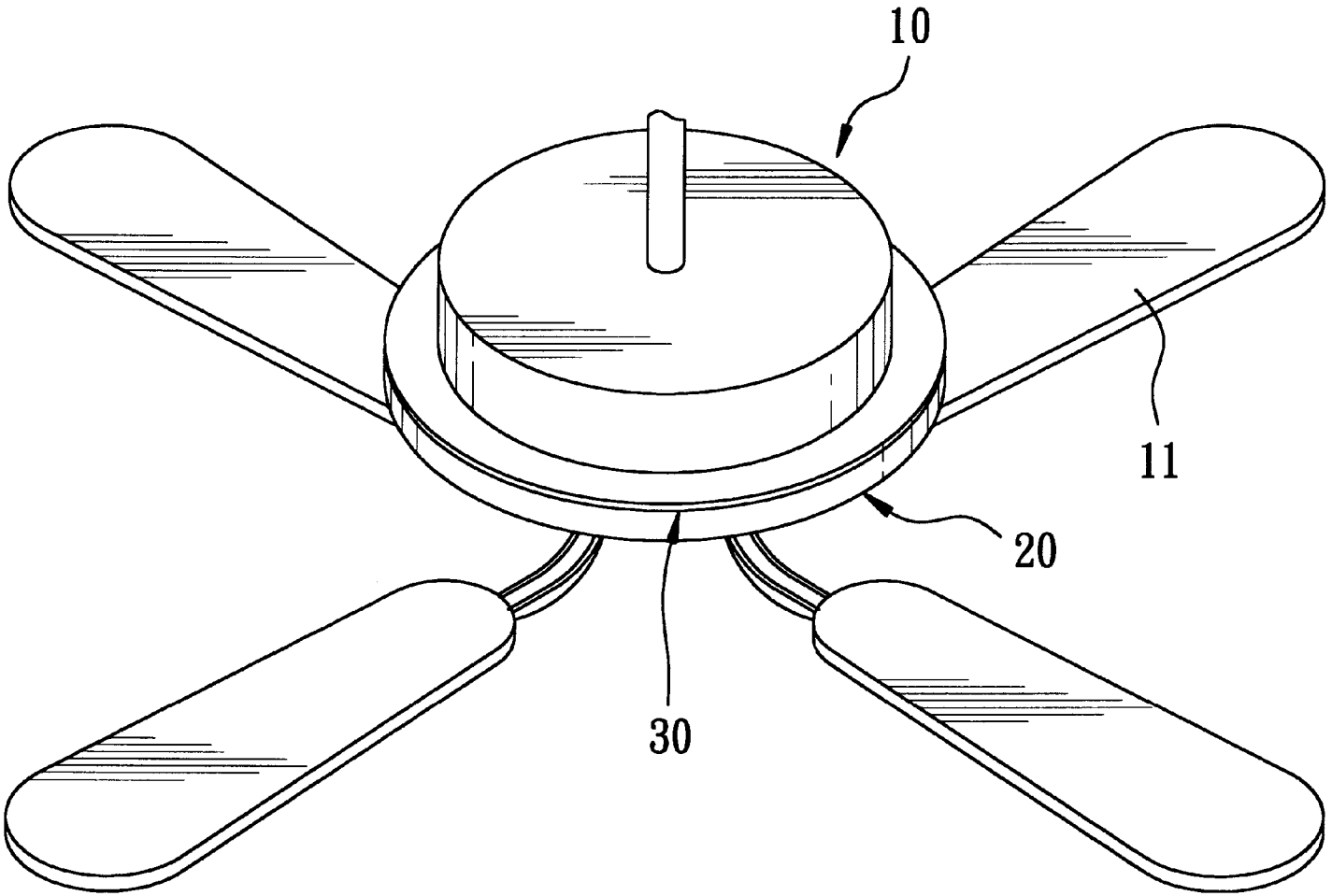
FIG. 2 is a perspective view illustrating the first preferred embodiment of a balancing ring according to the present invention when applied to a ceiling fan.
Figure 3:
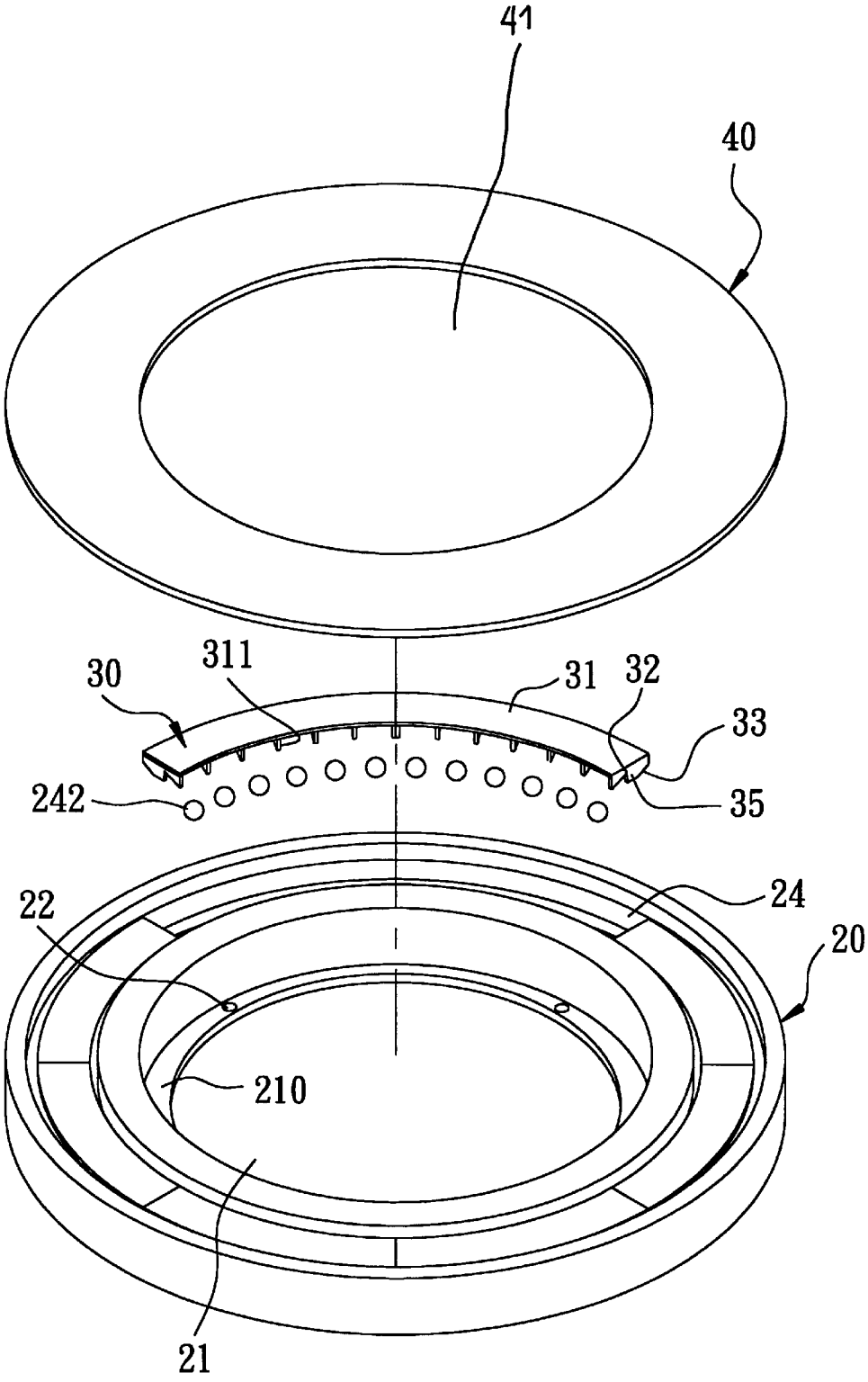
FIG. 3 is an exploded perspective view of the first preferred embodiment.

Referring to FIGS. 2 and 3, the first preferred embodiment of a balancing ring according to the present invention is shown to be mounted securely on a rotatable portion, such as a rotor, of a ceiling fan 10. The balancing ring includes a ring member 20, a ball restraining ring 30 and a cover member 40.

Figure 4:
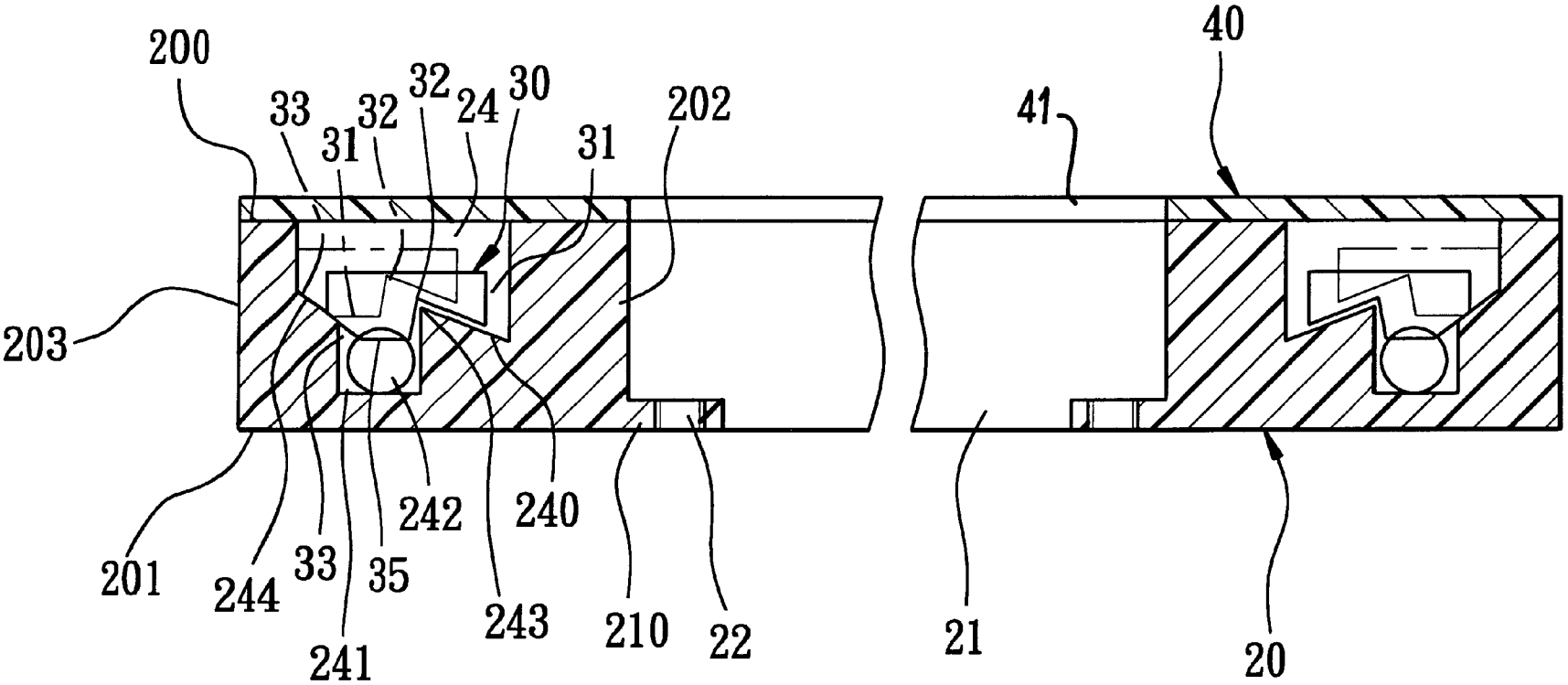
FIG. 4 is an assembled cross-sectional view of the first preferred embodiment.

With further reference to FIG. 4, the ring member 20 has a top side 200, a bottom side 201, an inner peripheral wall 202 that confines a central opening 21, and an outer peripheral wall 203. An annular flange 210 projects radially from the inner peripheral wall 202 into the central opening 21, and is formed with four angularly spaced fastener holes 22. An annular groove 24 is formed in the top side 200 between the inner and outer peripheral walls 202, 203. The groove 24 has a groove bottom with an annular inner bottom section 240 disposed around the inner peripheral wall 202, an annular intermediate recessed section disposed around the inner bottom section 240 and formed with an annular ball receiving recess 241 therealong, and an annular outer bottom section 244 disposed around the intermediate recessed section. The outer bottom section 244 extends radially and outwardly, and inclines upwardly with respect to an axis of the central opening 21. In this embodiment, the inner bottom section 240 also extends radially and outwardly, and inclines upwardly with respect to the axis of the central opening 21, thereby forming a pointed corner or apex 243 at a junction of the inner bottom section 240 and the intermediate recessed section. The ball receiving recess 241 has a plurality of metal balls 242, which serve as a movable weight, disposed therein.

The ball restraining ring 30 is formed from a plurality of radial ring plate segments 31 that are disposed side-by-side in the groove 24 above the groove bottom. Each of the ring plate segments 31 has a plurality of angularly spaced barriers 311 that depend downwardly therefrom. Each of the barriers 311 is formed as an upright plate disposed in a radial direction with respect to the axis of the central opening 21, and has a bottom side with an outer portion, an inner portion and an intermediate portion between the outer and inner portions. The outer portion has an inclined surface 33 that is seated slidably on the outer bottom section 244 to permit upward and downward sliding movement of the ring plate segments 31 along the outer bottom section 244. The intermediate portion cis formed with a gate projection 35 that extends into the ball receiving recess 241 when the ring plate segments 31 slide downwardly along the outer bottom section 244 to locate the ball restraining ring 30 in a restricting position, where each of the metal balls 242 is restricted from moving freely by an adjacent pair of the barriers 311, and that ceases to extend into the ball receiving recess 241 when the ring plate segments 31 slide upwardly along the outer bottom section 244 to locate the ball restraining ring 30 in a releasing position, where the barriers 311 cease to restrict and permit free movement of the metal balls 242 in the ball receiving recess 241. The inner portion of the bottom side of each of the barriers 311 is seated on the inner bottom section 240 of the groove bottom when the ball restraining ring 30 is in the restricting position. Preferably, the inner portion is formed with a notch 32 for seating the same removably on the inner bottom section 240 at the apex 243 when the ball restraining ring 30 is in the restricting position. In this embodiment, each of the ring plate segments 31 has a width in a radial direction with respect to the axis of the central opening 21, that is shorter than a width of the groove 24 measured in the radial direction. Each of the ring plate segments 31 further has a height in an axial direction of the central opening 21, that is shorter than a depth of the groove 24 measured in the axial direction. The ring plate segments 31 are thus movable inside the groove 24 in both the radial and axial directions with respect to the axis of the central opening 21.

The cover member 40 is used to cover the top side 200 of the ring member 20. The cover member 40 is annular in shape to complement the ring member 20, and has a central opening 41 aligned with the opening 21. The bottom side of the cover member 40 is mounted securely on the top side 200 of the ring member 20 with the use of known high frequency welding techniques.

Figure 5:
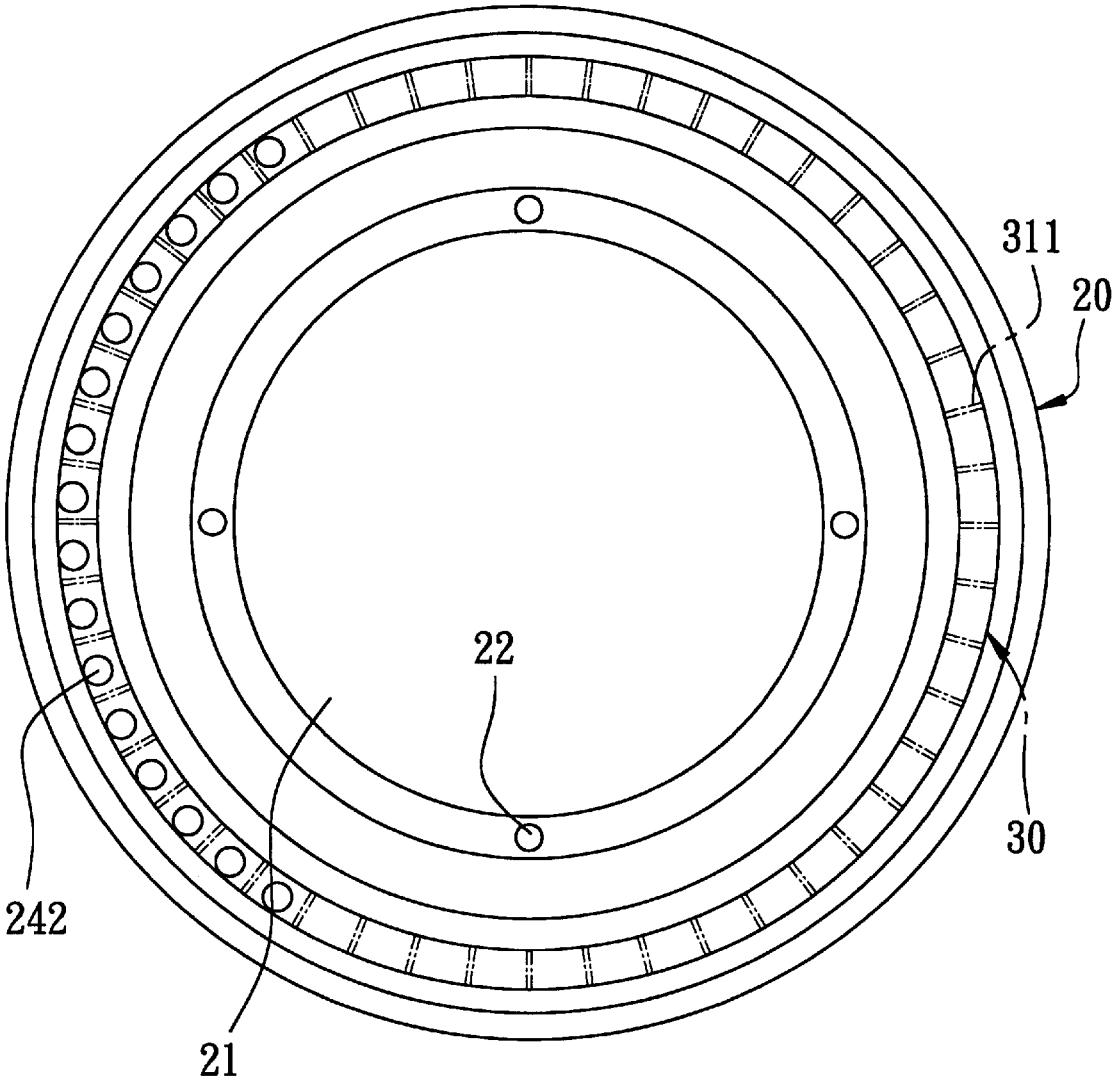
FIG. 5 is a schematic top view illustrating the balancing effect of the first preferred embodiment.

In use, the balancing ring is mounted securely on the bottom side or the top side of the rotor of the ceiling fan 10 via screw fasteners that extend through the fastener holes 22. Referring to FIGS. 4 and 5, when the motor (not shown) of the fan 10 begins to operate, the balancing ring rotates. Upon rotation of the balancing ring above a certain speed, inertial forces acting on the ring plate segments 31 cause the inclined surfaces 33 of the barriers 311 to move upwardly along the outer bottom section 244, thereby moving the ring plate segments 31 in both the radial and axial directions inside the groove 24. Eventually, the gate projections 35 of the barriers 311 will cease to extend into the ball receiving recess 241, thereby enabling the metal balls 242 to move freely in the ball receiving recess 241 to counteract any imbalance during rotation of the blades 11 of the fan 10. However, in order for the metal balls 242 to effectively balance the fan, the balancing ring must be rotating at a sufficiently high speed to allow the metal balls 242 to counteract the imbalance. When the fan operates on low speed, there is not enough movement to allow the metal balls 242 to move freely and balance the fan. In fact, the random movement of the metal balls 242 at low fan speeds can actually cause an imbalance. Thus, it is important for the metal balls 242 to be held in the stable position when the fan slows down and runs on low speed. When the rotating speed of the balancing ring slows down, the inclined surfaces 33 of the barriers 311 will move downwardly along the outer bottom section 244, thereby moving the ring plate segments 31 in both the radial and axial directions inside the groove 24 such that the gate projections 35 of the barriers 311 will once again extend into the ball receiving recess 241 so as to restrict movement of the metal balls 242 in the ball receiving recess 241. Thus, the outer bottom section 244 and the outer portion of the bottom side of each of the barriers 311 cooperate to form lifting means, inside the groove 24, for permitting movement of the ball restraining ring 30 in the groove 24 in response to rotating speed of the balancing ring. In order to balance the fan, the fan should run on high speed until the metal balls 242 achieve a balanced state. When the fan is turned off or switched to low speed, the metal balls 242 will be held in the balanced configuration.

Preferably, the number of metal balls 242 is fewer than the number of barriers 311, e.g. 1:3, for best results.

Since the balancing ring is mounted securely on the rotor, and not on each of the fan blades 11, the risk of untimely removal associated with the use of weights as taught in the prior art has been minimized, and the installation of the balancing ring of this invention can be conducted without the need for the assistance of a skilled technician.

Figure 6:
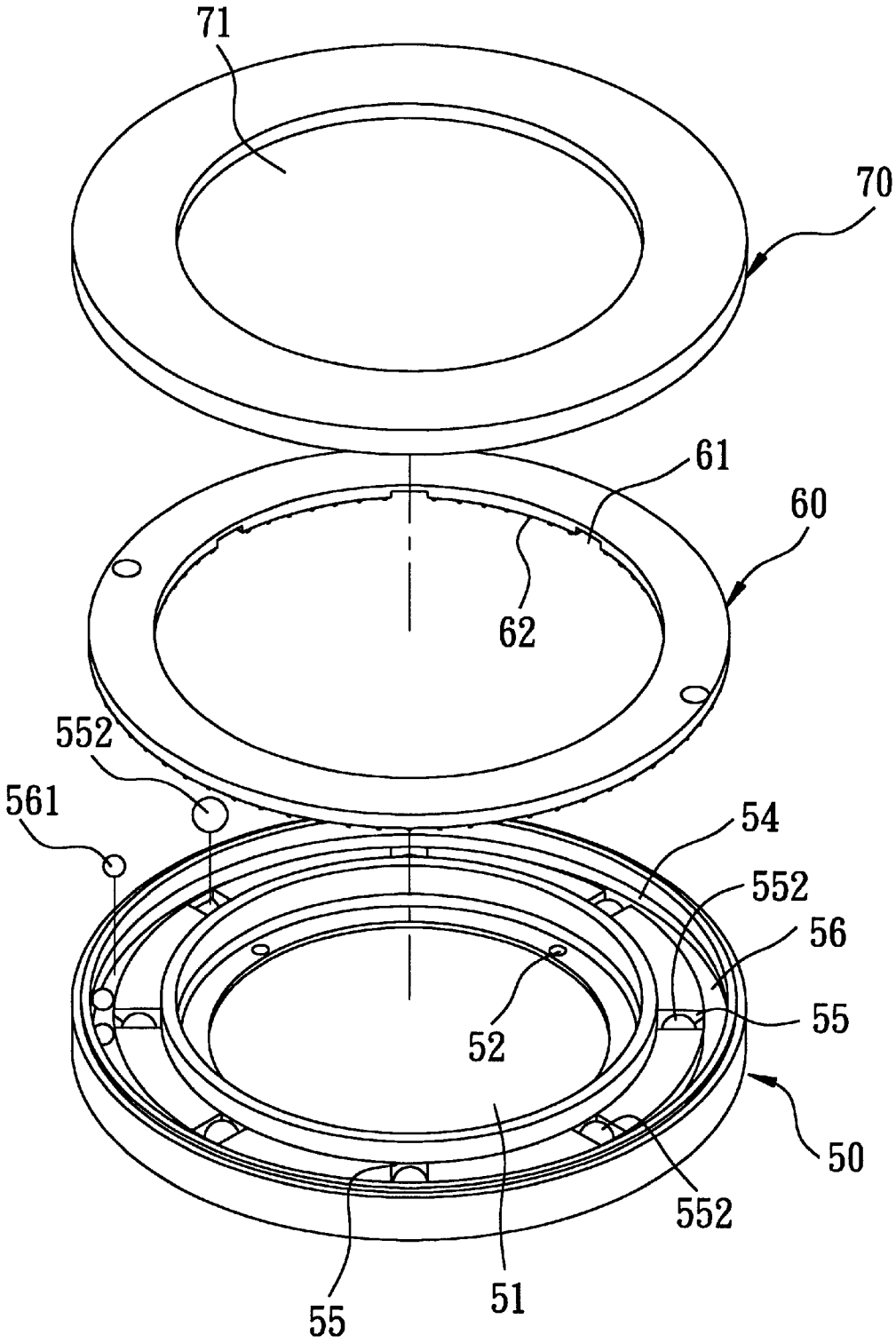
FIG. 6 is an exploded perspective view of the second preferred embodiment of a balancing ring according to the present invention.
Figure 7:
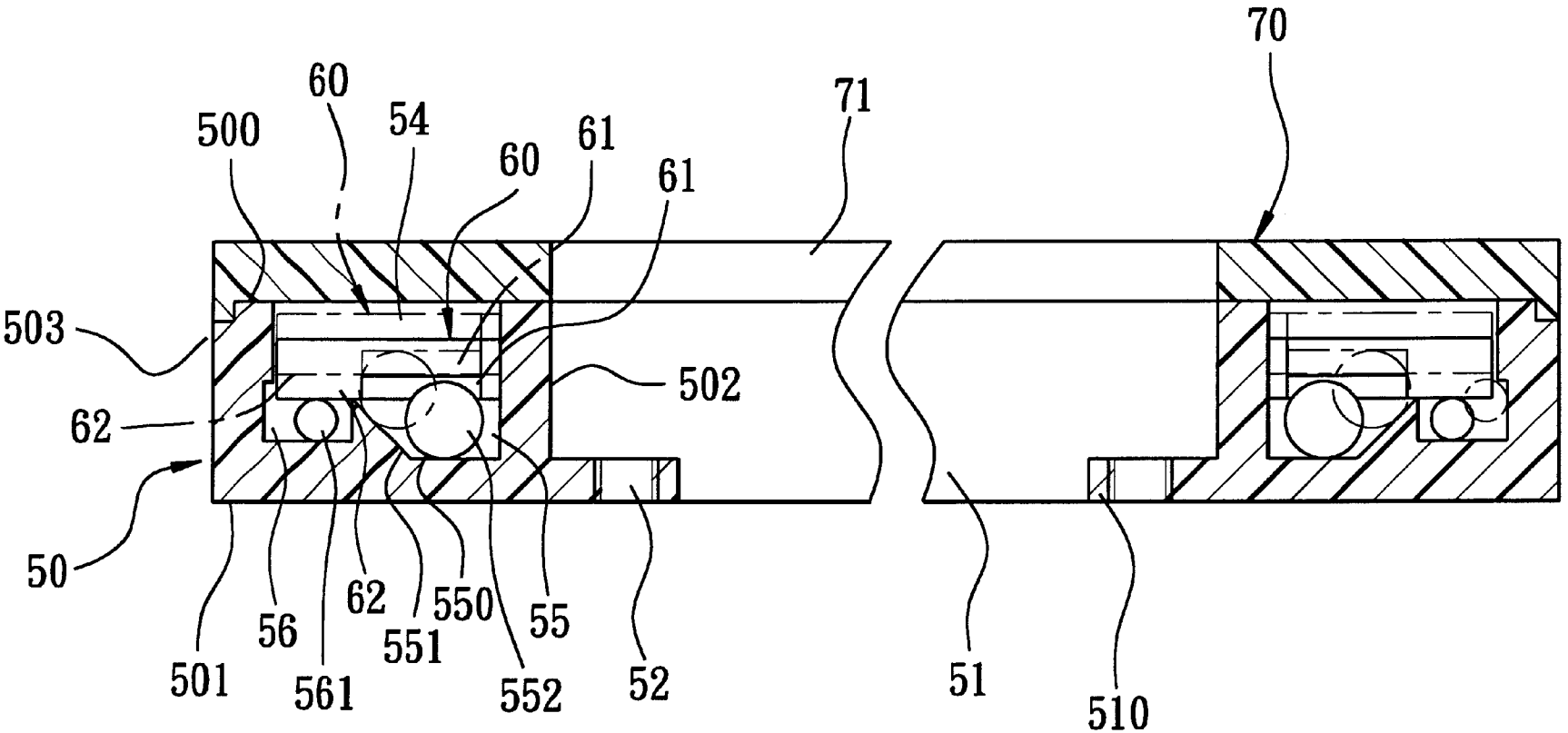
FIG. 7 is an assembled cross-sectional view of the second preferred embodiment.

Referring to FIGS. 6 and 7, the second preferred embodiment of a balancing ring according to the present invention is shown to also include a ring member 50, a ball restraining ring 60 and a cover member 70.

The ring member 50 has a top side 500, a bottom side 501, an inner peripheral wall 502 that confines a central opening 51, and an outer peripheral wall 503. Like the previous embodiment, an annular flange 510 projects radially from the inner peripheral wall 502 into the central opening 51, and is formed with angularly spaced fastener holes 52. An annular groove 54 is formed in the top side 500 between the inner and outer peripheral walls 502, 503. The groove 54 has a groove bottom with an annular outer recessed section surrounded by the outer peripheral wall 503 and formed with an annular ball receiving recess 56, and an annular inner section disposed between the outer recessed section and the inner peripheral wall 502. The ball receiving recess 56 has a plurality of metal balls 561, which serve as a movable weight, disposed therein. The annular inner section is formed with a plurality of angularly spaced ditches 55 that extend radially with respect to an axis of the central opening 51. Each of a plurality of control balls 552, which are larger than the metal balls 561 in diameter, is received in a respective one of the ditches 55. Each of the ditches 55 is defined by a planar base wall 550 and an upwardly inclining wall 551 that extends from one end of the base wall 550 toward the outer recessed section. Preferably, each of the metal balls 561 and the control balls 552 has an upper portion that protrudes upwardly relative to the annular inner section of the groove bottom.

The ball restraining ring 60 includes a ring plate 61 that is disposed in the groove 54 above the groove bottom. The ring plate 61 has a bottom side that contacts the upper portions of the control balls 552, and that is formed with a plurality of angularly spaced barriers 62 depending downwardly therefrom. The ball restraining ring 60 is movable inside the groove 54 between a restricting position, where each of the metal balls 561 is restricted from moving freely by an adjacent pair of the barriers 62, and a releasing position, where the barriers 62 cease to restrict and permit free movement of the metal balls 561 in the ball receiving recess 56. Preferably, each of the barriers 62 has a bottom end that is supported on the inner section of the groove bottom when the ball restraining ring 60 is in the restricting position. In this embodiment, the ball restraining ring 60 has a height in an axial direction of the central opening 51, that is shorter than a depth of the groove 54 measured in the axial direction, thereby permitting movement of the ball restraining ring 60 inside the groove 54 in the axial direction with respect to the axis of the central opening 51.

The cover member 70 is used to cover the top side 500 of the ring member 50. The cover member 70 is annular in shape to complement the ring member 50, and has a central opening 71 aligned with the opening 51. The bottom side of the cover member 70 is mounted securely on the top side 500 of the ring member 50 with the use of known high frequency welding techniques.

Figure 8:
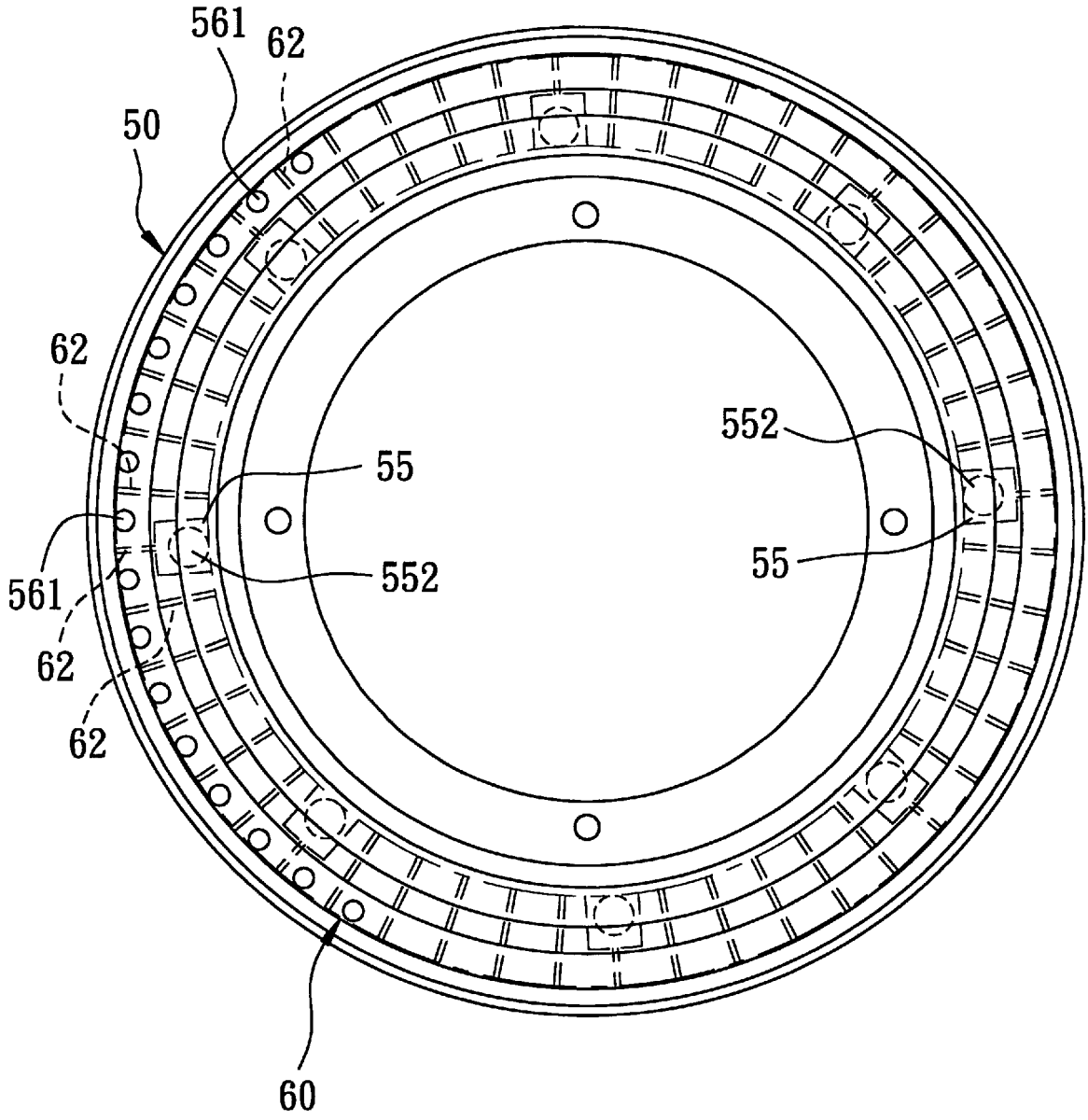
FIG. 8 is a schematic top view illustrating the balancing effect of the second preferred embodiment.

In use, the balancing ring is mounted securely on the bottom side or the top side of the rotor of the ceiling fan (not shown) via screw fasteners that extend through the fastener holes 52. Referring to FIGS. 7 and 8, when the motor (not shown) of the fan begins to operate, the balancing ring rotates. Upon rotation of the balancing ring above a certain speed, inertial forces acting on the control balls 552 cause the latter to move upwardly along the upwardly inclining wall 551 of the respective one of the ditches 55, thereby urging the ring plate 61 upwardly for moving the ball restraining ring 60 in the axial direction inside the groove 54. Eventually, the barriers 62 will cease to restrict the metal balls 561, thereby enabling the latter to move freely in the ball receiving recess 56 to counteract any imbalance during rotation of the blades of the fan. However, in order for the metal balls 561 to effectively balance the fan, the balancing ring must be rotating at a sufficiently high speed to allow the metal balls 561 to counteract the imbalance. When the fan operates on low speed, there is not enough movement to allow the metal balls 561 to move freely and balance the fan. In fact, the random movement of the metal balls 561 at low fan speeds can actually cause an imbalance. Thus, it is important for the metal balls 561 to be held in the stable position when the fan slows down and runs on low speed. When the rotating speed of the balancing ring slows down, the control balls 552 will move downwardly along the upwardly inclining wall 551 of the respective one of the ditches 55, thereby moving the ball restraining ring 60 in the axial direction inside the groove 54 such that the barriers 62 will once again restrict movement of the metal balls 561 in the ball receiving recess 56. Thus, the upwardly inclining wall 551 of each of the ditches 55 and the control balls 552 cooperate to form lifting means, inside the groove 54, for permitting movement of the ball restraining ring 60 in the groove 54 in response to rotating speed of the balancing ring. In order to balance the fan, the fan should run on high speed until the metal balls 561 achieve a balanced state. When the fan is turned off or switched to low speed, the metal balls 561 will be held in the balanced configuration.

Like the previous embodiment, the number of metal balls 561 is fewer than the number of barriers 62, e.g. 1:3, for best results.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A balancing ring for a ceiling fan, comprising:

a ring member having a top side, a bottom side, an inner peripheral wall that confines a central opening, an outer peripheral wall, and an annular groove formed in said top side between said inner and outer peripheral walls, said groove having a groove bottom formed with an annular ball receiving recess;

a plurality of metal balls disposed in said ball receiving recess;

a ball restraining ring disposed in said groove above said groove bottom, and movable inside said groove in at least an axial direction of said central opening between a restricting position, where said metal balls are restricted from moving freely, and a releasing position, where said metal balls are free to move in said ball receiving recess; and lifting means, provided in said groove, for permitting movement of said ball restraining ring in said groove in response to rotating speed of the balancing ring.

2. The balancing ring as claimed in claim 1, wherein:

said groove bottom includes an annular inner bottom section disposed around said inner peripheral wall, an annular intermediate recessed section disposed around said inner bottom section and formed with said ball receiving recess therealong, and an annular outer bottom section disposed around said intermediate recessed section, said outer bottom section extending radially and outwardly and inclining upwardly with respect to an axis of said central opening;

said ball restraining ring being formed from a plurality of radial ring plate segments that are disposed side-by-side in said groove above said groove bottom, said ball restraining ring having a plurality of angularly spaced barriers that depend downwardly from said ring plate segments, each of said barriers being formed as an upright plate disposed in a radial direction with respect to the axis of said central opening, each of said barriers having a bottom side with an outer portion, an inner portion and an intermediate portion between said outer and inner portions, said outer portion having an inclined surface that is seated slidably on said outer bottom section of said groove bottom to permit upward and downward sliding movement of said ring plate segments along said outer bottom section, said intermediate portion being formed with a gate projection that extends into said ball receiving recess when said ring plate segments slide downwardly along said outer bottom section to locate said ball restraining ring in the restricting position, and that ceases to extend into said ball receiving recess when said ring plate segments slide upwardly along said outer bottom section to locate said ball restraining ring in the releasing position;

said outer bottom section of said groove bottom and said outer portion of said bottom side of each of said barriers cooperatively forming said lifting means;

whereby, inertial forces acting on said ring plate segments during rotation of the balancing ring enable sliding movement of said ring plate segments along said outer bottom section to move said ball restraining ring between the restricting and releasing positions.

3. The balancing ring as claimed in claim 2, wherein said inner portion of said bottom side of each of said barriers is seated on said inner bottom section of said groove bottom when said ball restraining ring is in the restricting position.

4. The balancing ring as claimed in claim 3, wherein said inner bottom section of said groove bottom extends radially and outwardly and inclines upwardly with respect to the axis of said central opening, said inner portion of said bottom side of each of said barriers being notched for seating removably on said inner bottom section of said groove bottom when said ball restraining ring is in the restricting position.

5. The balancing ring as claimed in claim 1, wherein:

said groove bottom includes an annular outer recessed section surrounded by said outer peripheral wall and formed with said ball receiving recess therealong, and an annular inner section disposed between said outer recessed section and said inner peripheral wall, said annular inner section being formed with a plurality of angularly spaced ditches that extend radially with respect to an axis of said central opening, each of said ditches being defined by a base wall and an upwardly inclining wall that extends from one end of said base wall toward said outer recessed section, each of said ditches further having a respective control ball received therein;

said ball restraining ring including a ring plate that is disposed in said groove above said groove bottom and that has a bottom side;

said upwardly inclining wall of each of said ditches and said control ball in each of said ditches cooperatively forming said lifting means, wherein said control ball is movable along said upwardly inclining wall of the respective one of said ditches and has an upper portion contacting said bottom side of said ring plate;

whereby, inertial forces acting on said control ball during rotation of the balancing ring result in movement of said control ball along said upwardly inclining wall of the respective one of said ditches so as to urge said ring plate upwardly for moving said ball restraining ring from the restricting position to the releasing position.

6. The balancing ring as claimed in claim 5, wherein each of said metal balls has an upper portion, said upper portions of said metal balls and said control balls protruding upwardly with respect to said inner section of said groove bottom.

7. The balancing ring as claimed in claim 5, wherein said ball restraining ring has a plurality of angularly spaced barriers that depend downwardly therefrom, each of said barriers having a bottom end that is supported on said inner section of said groove bottom when said ball restraining ring is in the restricting position.

8. The balancing ring as claimed in claim 1, further comprising a cover member mounted securely on said ring member to cover said top side of said ring member.

* * * * *